United States Patent [19]

Brickhouse et al.

[11] 4,118,810

[45] Oct. 10, 1978

[54] PORTABLE CHAIR TUB

[76] Inventors: Preston E. Brickhouse, 2800 Maywood Dr., San Bruno, Calif. 94066; Clinton B. Dunlap, 8954 E. Marshall Pl., Tulsa, Okla. 74115

[21] Appl. No.: 790,458

[22] Filed: Apr. 25, 1977

[51] Int. Cl.[2] ..... A47K 3/00; A47K 33/02; A47K 3/22

[52] U.S. Cl. ..... 4/173 R; 4/145; 4/148; 4/178; 4/185 R; 4/185 S; 4/185 HB; 4/7

[58] Field of Search ..... 4/148, 185 S, 173, 178, 4/180, 145, 185 R, 185 HB, 185 L, 159, 6, 7, 182

[56] References Cited

U.S. PATENT DOCUMENTS

| | | | |
|---|---|---|---|
| 2,977,604 | 4/1961 | Miller | 4/185 R |
| 3,391,411 | 7/1968 | Miller, Jr. | 4/178 |
| 3,474,469 | 10/1969 | Steltz | 4/178 |
| 3,562,821 | 2/1971 | Queen | 4/146 |
| 3,571,818 | 3/1971 | J'acuzzi | 4/180 |
| 3,587,118 | 6/1971 | Compton | 4/146 |
| 3,614,952 | 10/1971 | Agnellino | 4/178 |
| 3,616,467 | 11/1971 | Drain | 4/146 |
| 3,662,409 | 5/1972 | Johannsson | 4/145 |
| 3,863,275 | 2/1975 | Brendgord et al. | 4/148 |
| 3,986,217 | 10/1976 | Doerr et al. | 4/178 |

*Primary Examiner*—Henry K. Artis
*Attorney, Agent, or Firm*—Robert E. Massa

[57] ABSTRACT

A portable bathing device comprises a body compartment having four sides and a bottom and having an open top. The body compartment includes a built-in seat, and has an L-shaped door in one side adjacent the seat with the wider port of the door at the top so that when the door is open, the L-shaped opening conforms substantially to the contour of the seat to permit easy, convenient, and safe access to the body compartment for an incapacitated person. The door is removably hinged to the body compartment, and sealing means are provided between the door edges and the body compartment to form a seal when the door is closed tightly in place. A supply water inlet is located in the wall of the body compartment below the seat with this water inlet communicating with flexible hose means attachable to a source of water supply. A shower hose with spray head at the end is connected to the hose means. A drain opening is located in the bottom of the body compartment and communicates with flexible hose means which is positionable in a suitable drain. A pump is positioned in the drain conduit, and attached to the pump is a conduit communicating with a recycle water inlet in the wall of the body below the seat. A valve is located in the drain conduit beyond the pump, so that recycling of water into the body compartment may be provided for a whirlpool effect by closing this valve and activating the pump to recycle water through the drain, pump, and back into the body compartment through the recycle water inlet which is slightly offset in the body compartment. The control valves are positioned in the space at the rear of the body compartment and below the seat so that these controls would not be accessible to an infirm person seated in the bathing device, but would require the attention of an attendant.

6 Claims, 4 Drawing Figures

PORTABLE CHAIR TUB

BACKGROUND OF THE INVENTION

This invention relates to bathing devices, and, more particularly, to bathing devices of a portable type for use where most convenient by invalids or physically limited persons.

Various types of portable bathing devices have been known for some time which have been intended to provide means for physically handicapped persons to bathe in relative comfort compared to the inconvenience and discomfort of their bathing in a conventional bath tub or shower stall. While some of the previous portable bathing devices have provided means for a handicapped person to transfer himself with less effort to the bathing device positioned adjacent his bed or wheel chair than he would endure in transferring himself to a bath tub, many of these devices still have inconvenient or potentially dangerous qualities. For example, some of these recently developed portable bathing devices include movable seats upon which the handicapped person must be seated, presumably, in most cases, in being transferred from his wheel chair to the bathing device. Also, in certain of these bathing devices the movable seat is constructed to extend slidably externally of the bathing device for a short distance so that the patient's wheel chair may be brought into position closely adjacent the seat. Other devices even incorporate the seat into the swinging door of the bathing device, upon which the patient seats himself, and then either he or an attendant swings the door shut so that the patient is then seated inside the device and the door forms a sealed enclosure.

It is obvious that there is a certain inherent danger involved in transferring a physically limited person from a wheel chair to a movable seat, especially to a seat positioned on a swinging door of the device. The physically limited person does not have complete control of his movements, and it is difficult enough for such a person to move his body to a substantially immovable seat, much less a seat which is likely to slide uncontrollably as he attempts to seat himself thereon.

Moreover, in all of the bathing devices which we have seen, the various means for controlling the flow of water into the bathing device, the temperature of the water, recycling of the water by activation of pump means, forced draining of the device, etc., have been positioned where these control means are available to the physically limited person occupying the device.

We believe that there is also a certain degree of inherent danger in placing the controls where they are accessible to the handicapped person because this person is using such a bathing device because his faculties are limited for some reason, either illness, age, post-operative weakened condition. If he is able only to open valves partially by reason of loss of strength or agility, or open wrong valves, turn on or off wrong switches by reason of loss of faculties through sedation, he is subject to considerable potential injury.

SUMMARY OF THE INVENTION

Therefore, the primary object of our invention is to provide a portable bathing device which is safe to operate.

Another object of our invention is to provide a portable bathing device which is easy to use, inexpensive, and simple to manufacture.

Still another object of our invention is to provide a portable bathing device which is relatively lightweight, sturdy, and easy to transport where desired.

Still another object of our invention is to provide a portable bathing device which is easily and quickly connectible to water supply and drain utilities.

These and other objects of our invention will become apparent from the description and drawings and attached claims which describe the invention as comprising a body compartment having four sides and a bottom, and having an L-shaped door opening in a side which door opening has its wider portion at its top; a door removably hinged to the body compartment in a manner to close the door opening; sealing means positionable between the door and the body compartment to form a water-tight seal when the door is closed; a seat formed in the body compartment extending contiguously between two opposite sides; the L-shaped door opening conforming substantially to the position of the seat; means for introducing water into the body compartment; and means for draining water from the body compartment.

We believe that with our invention we have overcome the potential dangers and inconveniences which we have observed to be rather prevalent in bathing devices known today. We have designed our portable bathing device so that an invalid, or otherwise handicapped person, who is restricted to a wheel chair, may move easily and with a minimum of effort, from his wheel chair positioned at the side of our bathing device onto the seat through the L-shaped opening which conforms substantially to the contour of the seat. The L-shaped door opening and the seat built contiguously with the sides, bottom, and rear of the bathing device permit the patient to enter the device in a position which is substantially normal to the position he would assume in seating himself, or being seated. He does not have to assume an abnormal, strained position to enter the device or to be seated therein. Our bathing device is also convenient for patients who are bedfast or temporarily bedfast, not confined to a wheel chair. The device may be moved into position adjacent the patient's bed and the patient may move, or be assisted in moving into the bathing device, easily, because the design of the door opening and seat permit the patient to assume normal movements in entering the device.

We also believe that we have provided additional safety factors with our device by placing the important control valves beneath and behind the seat so that they are inaccessible to the person seated within the bathing device. A person normally requires such a portable bathing device because his ability to move about is restricted for some reason, he is crippled by injury or disease, is infirm, is incapacitated after an operation, or is under sedation. There is a definitely higher risk involved for such a person to attempt to manipulate any type of controls by himself because he might inadvertently operate the wrong control. He might, by mistake, operate the wrong the mechanical control, such as when the bathing device includes a hydraulic seat, and cause injury to himself. Or, he might operate the wrong valve or water temperature control and cause himself to be scalded.

DESCRIPTION OF THE PREFERRED EMBODIMENTS

Figure 1:
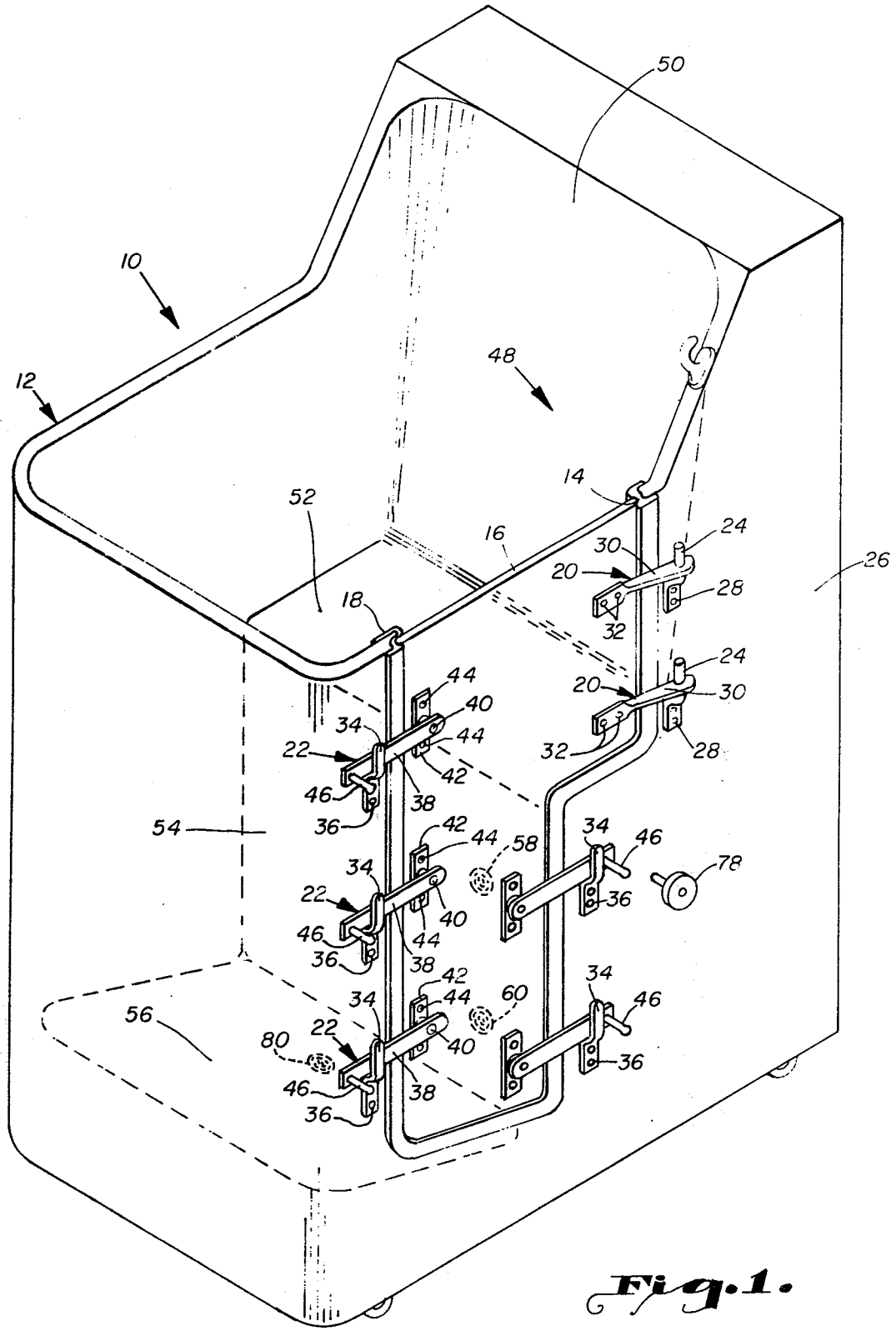
FIG. 1 is an isometric view of a portable bathing device according to this invention.

Referring now to the drawings in detail, FIG. 1 describes a bathing device 10, generally, according to our invention, which comprises a body compartment 12, generally, preferably molded of fiberglass, and which has therein an L-shaped door opening 14, fitted to receive a similarly shaped door 16. Door 16 fits closely within opening 14 and is made water-tight by compressing, when closed, a suitable rubber seal 18 around its sides. Door 16 swings, removably, on hinges 20, generally, and, when closed, can be secured by action of latches 22, generally. Hinges 20, generally, comprise a pin member 24 secured to side 26 of body compartment 12 by suitable means, such as rivets 28, and a support member 30 suitably secured on door 16 as by means of 32. Thus, support members 30 easily slip over pin members 24, and are easily removed therefrom to permit doors 16 to be removed from the body compartment for added convenience or easier cleaning. Latches 22 include a bracket member 34 suitably secured to side 26 as by rivets 36, and a swinging arm member 38 attached by means of rivet member 40 to plate member 42, which is secured to door 16 by rivets 44. Swinging arm 38 has a handle 46 attached to the end thereof.

Body compartment 12 is provided with a seat 48, generally, which includes a back support portion 50, horizontal seat portion 52, and lower support portion 54. Lower support portion 54 joins floor 56. Seat 48 is preferably molded integrally with body compartment 12 when the bathing device is made of fiberglass or similar moldable material, or should be joined contiguously with body compartment 12 to form smooth, round corners where the two components join, for easier cleaning and added comfort. In the same way, floor 56 should be molded integrally with body compartment 12 and seat 48, and should also have smooth, round corners at points of joinder.

Figure 2:
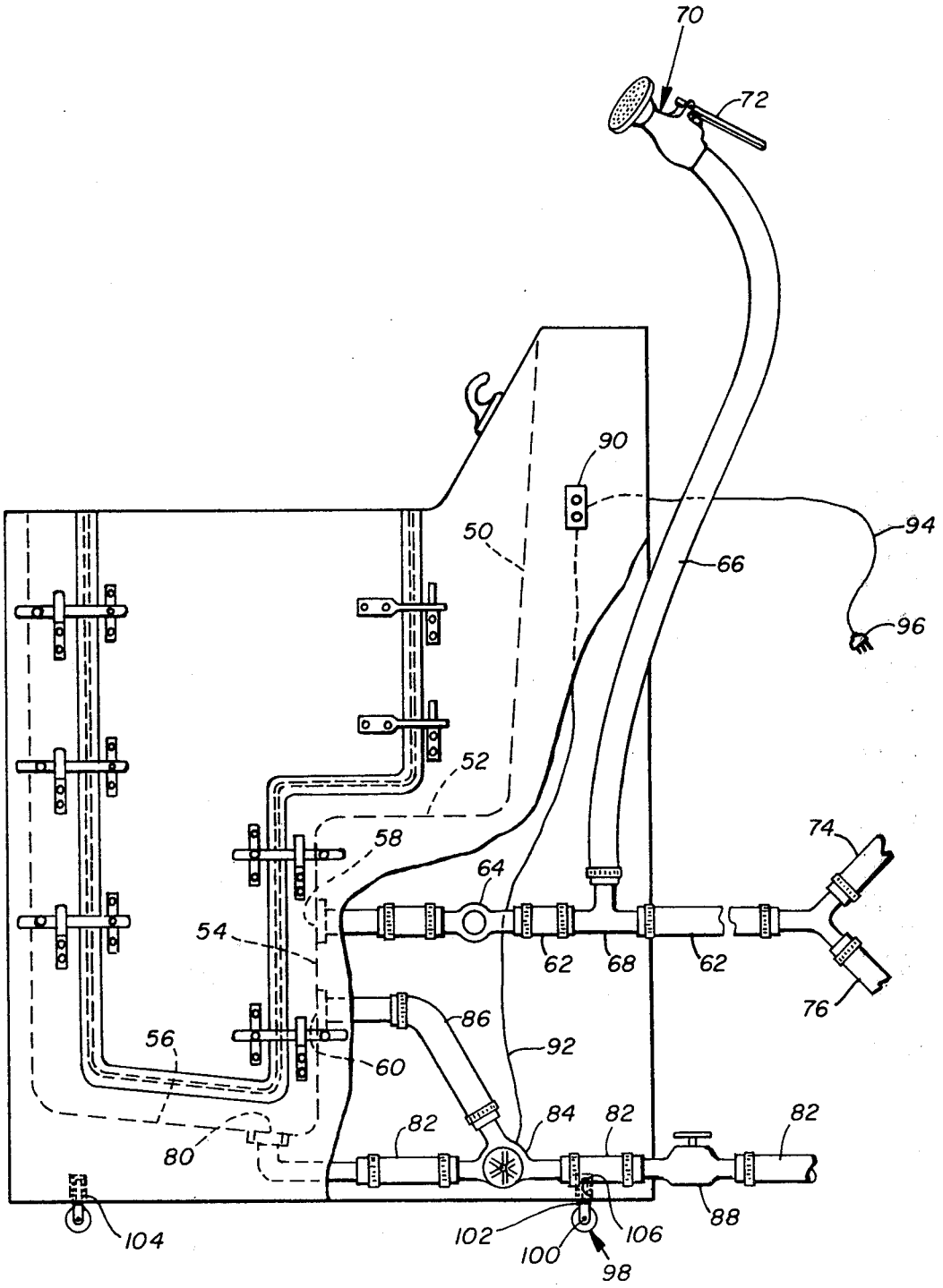
FIG. 2 is a side view of a bathing device according to our invention with a portion of the body removed to show underlying connections and controls.
Figure 4:
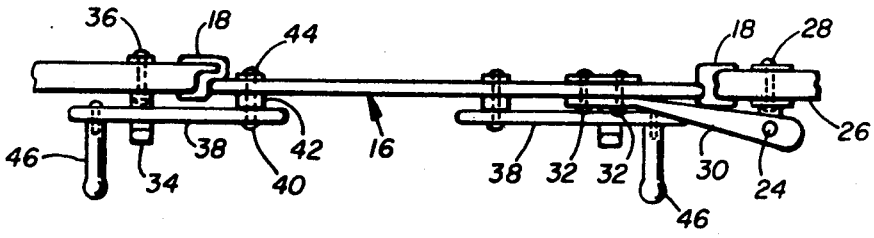
FIG. 4 is a top view, partly fragmentary, of the door structure of a bathing device according to our invention.
Figure 3:
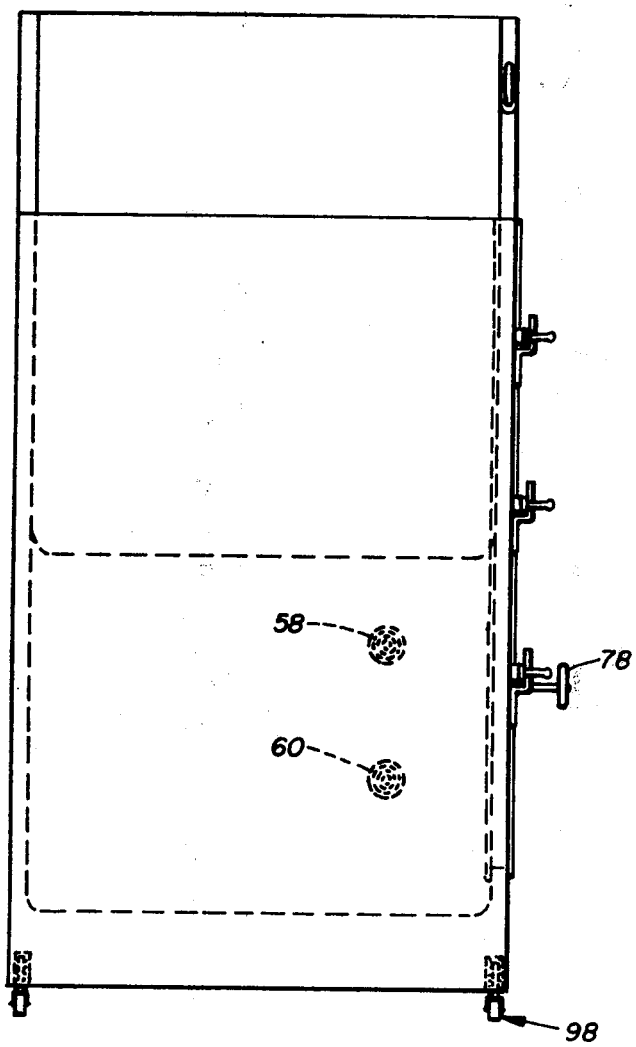
FIG. 3 is a front view of a bathing device according to our invention.

FIG. 2 clearly shows the connections to utilities, means for connection to source of water supply, means for connection to drainage facilities, and means for recycling water. In lower portion 54 are located a supply water inlet 58 and a recycle water inlet 60. Supply water inlet 58 communicates with conduit means 62, which may include flexible hose means, and includes a valve 64, as a means of shutting off the water supply as well as providing means for diverting water into a spray hose 66 attached to T-joint 68. Spray hose 66 has a spray head 70, generally, at its end which includes a conventional spring-loaded on-off valve 72 to permit water to be discharged from spray head 70 when it is depressed and valve 64 is open with hose connections 74 and 76 made to water supply faucets (not shown) which are turned on. Valve 64 has its handle 78 passing through side 26 at a position where it is readily available to an attendant but not within the convenient reach of the patient seated in the bathing device.

Also described in FIG. 2 is drain opening 80 communicating with conduit means 82 which has located therein a pump 84 to which pump 84 conduit means 86 is attached and which further communicates with recycle water inlet 60. Conduit means 82 further includes a valve 88. Conduit means 82 normally is placed within some type of drain means, for example, a bath tub, a sink, or a toilet stool, and, with valve 88 open, pump 84 is actuated by pressing switch 90 connected to pump 84 by line 92 and to a typical domestic electric outlet through line 94 and plug 96, and pump 84 forces water from within body compartment 12 through the conduit means 82 and into the drain means.

For a whirlpool effect of the water within the body compartment 12, valve 88 is closed, pump 84 is actuated, and water is recycled through drain 80, conduit means 82, pump 84, conduit means 86, and out recycle water inlet 60 to return to the lower portion of body compartment 12. Thus, with the water level above recycle water inlet 60, the whirlpool effect is generated because recycle water inlet 60 is slightly offset in lower portion 54 of the seat.

For convenience in moving the bathing device, we have provided the device with spring-loaded casters 98, generally, which include rollers 100 attached rotatably to shafts 102 secured to spring members 104 which is further positioned with receptacle 106 such that the bathing device can be moved freely about on rollers 100, but when the patient is seated within the bathing device, his weight overcomes the resistance of springs 104 and the rollers become essentially immovable in a conventional manner. It may also be apparent that our bathing device may be provided with one or more locking type rollers (not shown) for further securing the immobility of the bathing device.

Since many different embodiments of this invention may be made without departing from the spirit and scope thereof, it is to be understood that the specific embodiments described in detail herein are not to be taken in a limiting sense, since the scope of the invention is best defined by the appended claims.

We claim:

1. A portable bathing device, comprising:

a body compartment having four sides and a bottom, and having an L-shaped door opening in a side which door opening has a wider portion at its top than at its bottom, a door removably hinged to the body compartment in a manner to close the door opening, sealing means positionable between the door and the body compartment to form a water-tight seal when the door is closed, an L-shaped seat formed in the body compartment against a rear wall of said body compartment and extending contiguously between two opposite sides, the L-shaped door opening conforming substantially to the position of the seat, means for introducing water into the body compartment, and means for draining water from the body compartment.

2. A portable bathing device as described in claim 1 which includes means to provide a whirlpool effect to the water within said body compartment.

3. A portable bathing device as described in claim 2 wherein said means for draining water from the body compartment comprises:

a drain opening in the bottom of the body compartment, conduit means attached to and communicating with said drain opening, valve means disposed in said conduit means, and pump means disposed in said conduit means between said drain opening and said valve means.

4. A portable bathing device as described in claim 3 wherein the means to provide a whirlpool effect to the water within said body compartment comprises:

a recycle water inlet in a wall of the body compartment beneath the seat, said inlet offset from center, and conduit means connecting said first inlet to the pump means, whereby in conjunction with closure of the aforesaid valve means and activation of the pump means, water within the body compartment is withdrawn through said drain opening, is circulated through said pump means, and re-enters the body compartment through said recycle water inlet.

5. A portable bathing device as described in claim 1 wherein the means for introducing water into the body compartment comprises:

a supply water inlet in a wall of the body compartment beneath the seat, conduit means connected to said supply water inlet and connectible to a source of water supply, and valve means in said conduit means.

6. A portable bathing device as described in claim 5 which includes shower means connected to that conduit means which is connected to said supply water inlet, said shower means comprising a shower head at the end of a flexible hose, said shower head including spring-loaded valve means.

* * * * *